United States Patent [19]

Nilsson

[11] 4,033,713

[45] July 5, 1977

[54] SAFETY DEVICE FOR BUTTERFLY DAMPERS

[76] Inventor: Sven Arne Nilsson, Hassle 12, S-240 36 Stehag, Sweden

[22] Filed: Aug. 21, 1975

[21] Appl. No.: 606,527

[30] Foreign Application Priority Data

Apr. 24, 1975 Sweden ..... 7504738

[52] U.S. Cl. ..... 431/153; 126/286

[51] Int. Cl.² ..... F23N 3/00

[58] Field of Search ..... 431/20, 153, 18, 19; 126/286

[56] References Cited

UNITED STATES PATENTS

| | | | |
|---|---|---|---|
| 2,877,834 | 3/1959 | Campbell | 431/20 X |
| 3,010,451 | 11/1961 | Hodgins | 431/20 X |
| 3,405,690 | 10/1968 | Burrus | 431/20 X |

*Primary Examiner*—Alan Cohan
*Attorney, Agent, or Firm*—John J. Dennemeyer

[57] ABSTRACT

A safety device for butterfly dampers is mounted in the flue duct of oil fired central heaters and operated by a control device susceptible of rotating a damper element actuated by the pressure of fuel oil fed by a pump through an oil supply line to a burner head to open and close the flue duct. A valve device is mounted in the oil supply line between the oil pump and the burner head and controlled by a position indicator associated with the damper device. The rotation of the damper element is transferred to the position indicator who relays the signal to the valve device. Accordingly a rotation of the damper element toward the closing position will actuate the valve device to close the oil supply line and extinguish the heater.

2 Claims, 3 Drawing Figures

SAFETY DEVICE FOR BUTTERFLY DAMPERS

The present invention relates to a safety device for butterfly dampers, which are arranged in the flue duct of oil fired central heaters and which are regulated by a control device which on the one hand rotates the damper for opening the flue duct as the central heater starts and on the other hand rotates the damper back as the central heater stops.

It has previously been known to provide dampers of this type with safety device that prevent the burner head of the central heater from being actuated when the damper keeps the flue duct closed, or continues to operate when the damper is rotated from open to closed position for some reason. The existing safety devices are expensive and require extensive installation work. In addition the existing safety devices operate with a certain delay which produces a deposit of soot in the central heater and in turn causes a rise in oil consumption. If breakdowns occur in any of the components of the known safety devices, it often happens that the burner head keeps operating even if the damper keeps the flue duct closed or closes it.

It is an object of the present invention to eliminate these drawbacks and bring about a safety device that is inexpensive, easy to install, and which operates fast enough to eliminate or almost eliminate afterburning and thus the deposit of soot caused by the afterburning. Furthermore the safety device is not disconnected even if breakdowns arise.

The invention will be further described hereafter with reference to the accompanying drawings in which.

Figure 1:
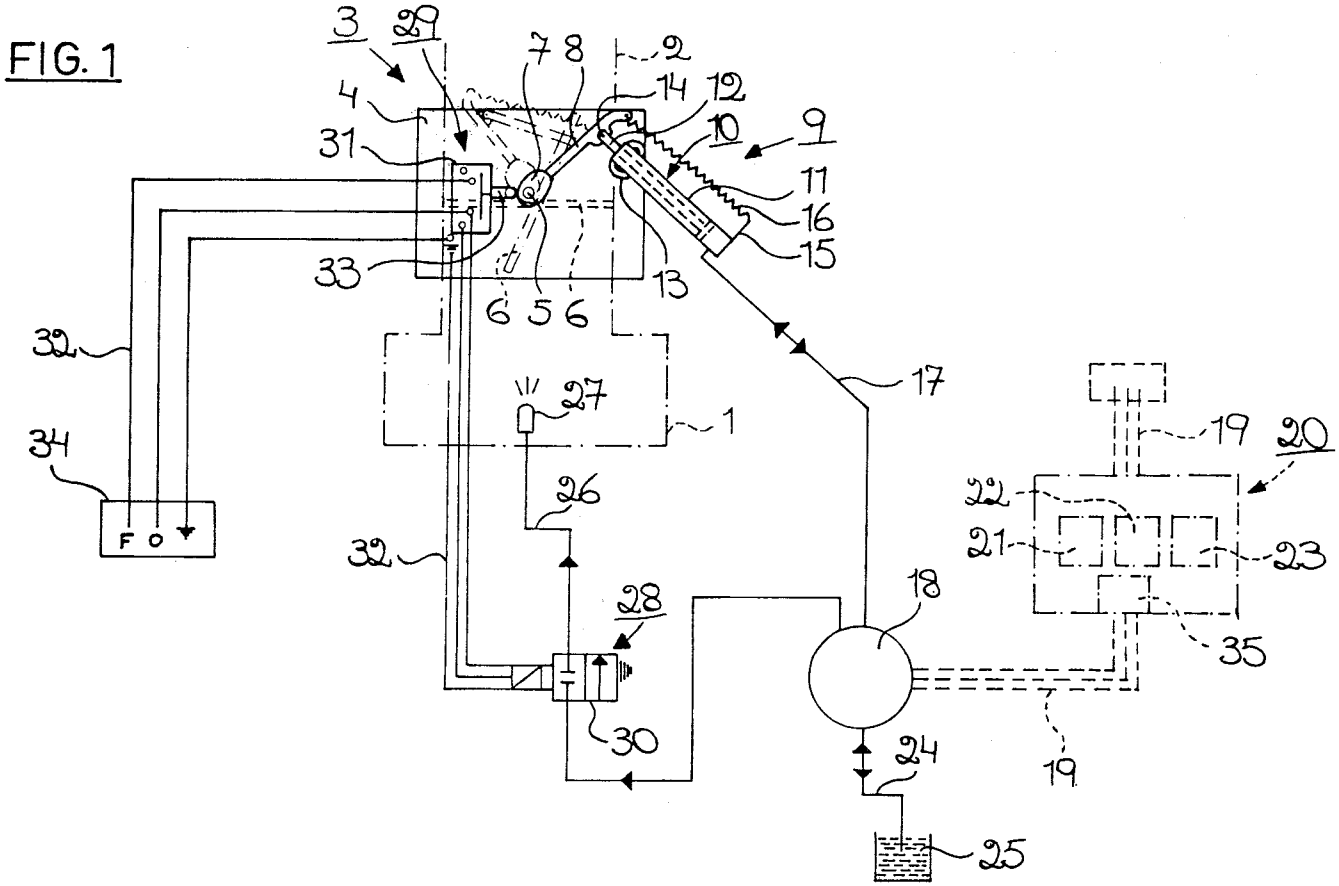
FIG. 1 illustrates diagrammatically a safety device according to the invention in a plan view.

FIG. 1 shows a diagrammatic view of a central heater 1 connected by a flue duct 2 to a chimney (not shown), and a damper device 3. The damper device 3 consists, according to the embodiment illustrated, of a stand plate 4 which is to be attached to the outside of a flue wall. On the stand plate 4 an axle 5 is pivoted which projects through the plate 4 and carries on one side of this plate a damper disc 6 and on the other side an eccentric disc 7 and an arm 8. The stand plate 4 covers a hole (not shown) of the flue wall and the damper disc 6 is disposed in the flue duct 2 whereas the eccentric disc 7 and the arm 8 are on the outside of the stand plate 4. The damper disc 6 is of such a size that it can be rotated between a completely or almost completely closed position of the flue duct 2 and a completely or partly open position of the flue duct (such a position is shown in dotted lines in FIG. 1).

The rotation of the damper disc 6 takes place by means of a control device 9 which comprises a cylinder piston device 10, whose cylinder 11 is pivoted in a bearing 13 on the stand plate 4. The piston 12 of the cylinder piston device 10 is rotatably connected to the arm 8 by a joint 14. Between the outer end of the arm 8 and a holder 15 on the cylinder 11 a tension spring 16 is fitted which serves as a return spring.

The pressure chamber of the cylinder 11 is connected to the oil pump 18 of the central heater 1 by an oil delivery - oil outlet pipe 17. It is driven by an electric engine (not shown) which is connected to the mains current by a feed cable 19. The feed cable 19 passes the electric control system 20 of the central heater, which has a thermostat device 21, a relay 22 and possibly a pyrostat 23. These components of the control system 20 decide when the central heater 1 is to started or stopped. The oil pump 18 is connected to an oil tank 25 by an oil delivery - oil outlet pipe 24. In addition thereto the oil pump 18 is connected to the burner head 27 of the central heater by an oil delivery pipe.

At the start of the oil pump 18 the pressure chamber of the cylinder will be supplied with oil through the pipe 17 and the piston 12 will be advanced so that the arm 8 and thereby the damper disc 6 is rotated from closed to open position. Simultaneously the burner head 27 will be supplied with oil and will function. When the oil pump 18 stops the pressure in the pipe 17 and in the pressure chamber of the cylinder 11 will decrease so that the damper disc 6 is rotated back to closing position by the retracting spring 16.

According to the invention the safety device will close the oil delivery pipe 26 by simple means and without any delay, and it will quickly interrupt the oil supply between the oil pump 18 and the burner head 27 if the damper disc 6 for some reason is rotated from open to closed position. According to the invention this is principally obtained by the fact that the oil delivery pipe 26 has a valve device 28 which is influenced by a position indicator 29. This position indicator 29 causes the valve device 28 to interrupt the open connection for oil flow between the oil pump 18 and the burner head 27 when the damper disc 6 rotates toward its closing position of the flue duct 2.

An especially suitable electromechanical safety device is illustrated in FIG. 1. According to the embodiment illustrated the oil delivery pipe 26 shows a valve device in the shape of a magnetic valve 30 and the position indicator consists of a limit switch 31. This limit switch constitutes the contact breaker of the electric line 32 to the magnetic valve 30.

The limit switch is arranged on the stand plate 4 and has a contact device 33 which is kept in the breaking position of the electric line 32 by means of a spring device (not shown). The contact device 33 cooperates with the eccentric disc 7 of the damper so that the electric line 32 is interrupted when the damper disc 6 is in closing position of the flue duct 2, or it is immediately interrupted when the damper disc 6 (because of the fact that the oil pump 18 stops or for some other reason) is rotated from opening to closing position. The safety device according to this alternative embodiment permits the oil flow to the burner head 27 to be stopped very quickly even by a slight movement of the damper disc 6 from open to closing position, since the magnetic valve 30 closes the oil delivery pipe immediately in a well-known manner when the current of line 32 is interrupted.

When the damper disc 6 is rotated back to open position and obtains a certain minimal opening degree the eccentric disc 7 influences the contact device 33 against the effect of the spring device to reconnect the feed cable 32 to the magnetic valve 30 which immediately opens the oil delivery pipe 26.

In addition to the fact that the illustrated safety device operates very fast without requiring a precise adjustment of the limit switch 31 in relation to the damper device the oil delivery pipe 26 is always kept closed by the magnetic valve 30 if breakdowns in the limit switch 31 or the magnetic valve 30 should occur. With a limit switch 31 embodied in this manner there is no risk that the contact device 33 "burns" at its contacts since it is spring-loaded in a direction away from them. With regard to the magnetic values of the type illustrated their opening and closing components cannot stay in the open position if an inside breakdown occurs, but these components move immediately to the closing position.

In order to achieve a further reduction of the time interval between the stopping of the oil pump 18 and the closing of the oil delivery pipe 26 the contact device 34 of the electric line 32 can, instead of being connected to the mains current, be connected to a contact 35 of the control system 20 of the central heater 1 so that the magnetic valve 30 closes at the same moment the thermostat 21 of the central heater 1 switches off the current thereto. As a consequence the afte. burning, accompanied by deposit of soot in the central heater 1, will be prevented completely, the magnetic valve 30 will be closed before the damper disc 6 begins its return stroke toward the closing position. Also the limit switch 31 will, as an extra safety device, interrupt the electric line 32, but this takes place somewhat later, as the damper disc 6 has been turned a little toward the closing position.

Figure 2:
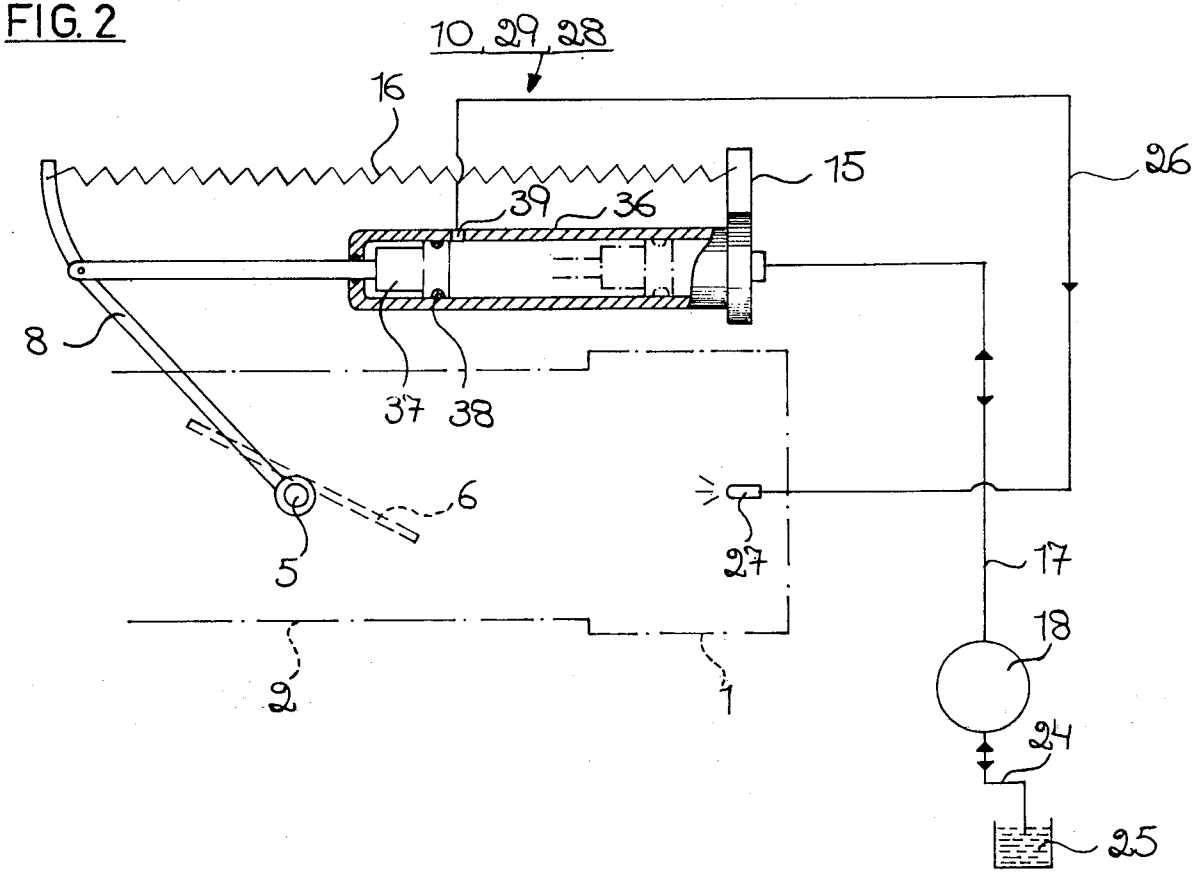
FIG. 2 illustrates diagrammatically an alternative embodiment of the safety device according to the invention in a plan view.

The safety device according to FIG. 2 works in a completely mechanical way and in the illustrated embodiment the cylinder-piston device 10, the position indicator 21 and the valve device 28 constitute one unit.

In this embodiment the pressure chamber of the cylinder-piston device is also connected to the oil-pump 18 by an oil delivery - oil outlet pipe. When the oil pump starts, the pressure in the pressure chamber of the cylinder 36 increases and the piston is moved to the left, rotating the arm 8 and thereby the damper disc 6 to open position. When the piston 37 has moved the major part of its way a packing ring mounted thereon will pass a side opening 39 in the wall of the cylinder 36 and oil flows through this opening 39 and through the oil delivery pipe 26 to the burner head 27, which is actuated. The piston occupies one of its end positions immediately after the moment that its packing ring has passed the side opening 39. This means that the piston 37 at a starting short return stroke immediately closes the opening 39 when the oil pressure in the pressure chamber of the cylinder 36 decreases or ceases and the retracting spring 16 moves the damper disc 6 toward the closing position. Thus the safety device also works quickly, closing the oil supply to the burner head 27, thereby preventing afterburning and deposit of soot in the central heater 1. Additionally the device is constructed in the simplest possible way and therefore it is reliable in operation and inexpensive.

Figure 3:
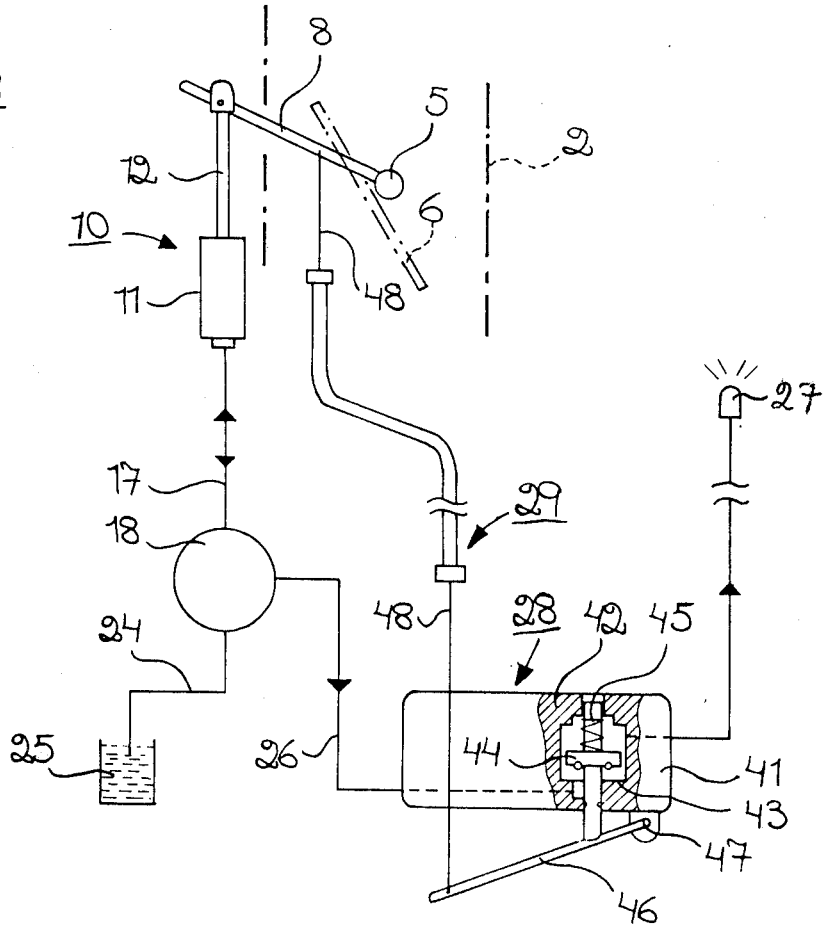
FIG. 3 illustrates diagrammatically another alternative embodiment of the safety device according to the invention in a plan view.

An alternative mechanically operating safety device is illustrated in FIG. 3. In this embodiment the valve device consists of a completely mechanical valve 41, which has a clack box 42 with a percolation chamber, which on one side of a valve seat 43 communicates with the branch of the oil delivery pipe 26 coming from the oil pump 18 and on the other side of the valve seat 43 communicates with the branch of the oil delivery pipe 26 that is extended to the burner head 27. In the percolation chamber a valve body 44 is displaceably arranged. It is loaded by a spring 45 which is directed toward the valve seat 43. The valve body 44 projects from the clack box 42 cooperating with a lever 46 attached on one side of the valve body 44 to the valve device 41 by a joint. On the other side of the valve body 44 the lever 46 is connected to a transmission device, for instance a wire cable 48 or the like, which in turn is attached to the arm 8. When the arm 8 and the damper disc 6 are rotated back (for instance by means of a spring not shown) toward the closing position of the flue duct 2 the rotary motion is transmitted by the lever 48 to the arm of the lever 46 and the valve body 44 is displaced and fitted to the valve seat 43 whereby the oil supply of the burner head 27 by the oil delivery pipe 26 is immediately interrupted.

What is claimed is:

1. A safety device for an oil fired central heater having a butterfly damper mounted in the flue duct of the heater, said heater including burner means, pump means for pumping oil to said burner means, and control means for actuating said pump means, said safety device comprising:

hydraulic means connected with said butterfly damper for operating the same, said hydraulic means being arranged to open said damper when operating fluid under pressure is supplied thereto, and to close said damper when the pressure of said operating fluid is relieved;

first conduit means connecting said pump means with said hydraulic means, whereby oil is transmitted to said hydraulic means under pressure when said pump means is actuated, said oil serving as the operating fluid for said hydraulic means;

second conduit means connecting said pump means with said burner means, and including a normally closed magnetic flow control valve;

position indicator means carried by said butterfly damper;

normally open switch means arranged to be closed by said position indicator means when said butterfly damper is open, and to open when said damper moves from said open position; and an electrical circuit connecting said normally open switch means with said normally closed magnetic flow control valve, and arranged to supply electric current to said magnetic valve for opening the same to allow oil to flow to said burner means, only when said butterfly damper is open whereby said position indicator means is effective to close said normally open switch means.

2. A safety device as recited in claim 1, wherein said control means for actuating said pump means includes a thermostat switch device connected to control the flow of electrical energy to said central heater, said electrical circuit connecting said normally open switch means with said normally closed magnetic flow control valve being supplied with energy through said thermostat switch device, whereby said solenoid flow control valve will close in response to said thermostat switch device opening.

* * * * *